US005767467A

United States Patent [19]

Grant

[11] Patent Number: 5,767,467

[45] Date of Patent: Jun. 16, 1998

[54] GRAVITY ACTUATED ELECTRICAL SWITCH

[76] Inventor: Bernard Grant, 29 Riverview St., Brockton, Mass. 02402

[21] Appl. No.: 657,686

[22] Filed: May 31, 1996

[51] Int. Cl.[6] ..... H01H 35/02

[52] U.S. Cl. ..... 200/61.52; 200/61.45 R; 200/61.83; 340/689

[58] Field of Search ..... 340/689; 200/61.52, 200/61.45 R, 61.83

[56] References Cited

U.S. PATENT DOCUMENTS

| | | | |
|---|---|---|---|
| 3,712,405 | 1/1973 | Dillmann | 108/104 |
| 3,753,474 | 8/1973 | Dillmann | 180/104 |
| 4,513,183 | 4/1985 | Hill | 200/61.45 |
| 5,278,540 | 1/1994 | Caban-domenech | 340/601 |

*Primary Examiner*—Peter S. Wong
*Assistant Examiner*—Shawn Riley
*Attorney, Agent, or Firm*—John M. Brandt

[57] ABSTRACT

A gravity actuated electrical switch in which electrical contact is made and then broken as the switch is moved from a horizontal to a vertical position consisting of a container within which is disposed a metallic rollable member, a vertical wall member within the container of a height to allow the rollable member to pass over the top of the wall, a pair of electrical contacts capable of being bridged by the rollable member positioned against the wall, and a horizontal ramp member forward of the contacts. Motion of the switch causes the rollable member to move forward, bridge the contacts and then fall to the forward end of the container. Return motion causes the rollable member to move back along the ramp and pitch over the wall without again joining the contacts.

9 Claims, 3 Drawing Sheets

GRAVITY ACTUATED ELECTRICAL SWITCH

BACKGROUND OF THE INVENTION

1. Field of the Invention

The invention resides in the field of the gravity actuated electrical switches and more particularly relates to a switch in which contact is made and then broken by the same motion.

2. Description of the Prior Art

Gravity actuated electrical switches are known in the prior art. They operate through the motion of the switch body usually attached to a platform as a secondary component. Various forms are utilized for effecting the making or breaking of an electrical contact. For example, pendulum switches are used in electric heaters to shut the heater off if it should tip over.

In an additional example of the type described herein, a sealed container is partially filled with mercury which flows to envelop contacts at one end of the container as it is moved from one position to another.

As best known to the inventor none of the gravity switches found in the prior art accomplish the purpose of the invention to make and then break electrical contact with a single motion and then to reset with a reverse or counter motion without again making and breaking contact.

The switch described below has been found to function extremely well in the activation of a sound module. The inventor is unaware of any motion operated switch which will activate a sound module to produce an audible message upon the repositioning of a physical object such as a door knob or toilet seat.

SUMMARY OF THE INVENTION

The invention may be summarized as an electrical switch which first makes and then breaks electrical contact through the motion of the switch from a horizontal to a vertical position. Contact is made by a rolling metallic member, preferably a ball, bridging a pair of electrical contacts disposed in an upright position on a vertical wall forward of the ball. The ball may be held in a rest position in a seat rearward from the contacts to prevent undesired actuation until a deliberate motion of the switch is provided.

As the switch body, a cylindrical container for example, is moved from the horizontal to the vertical, the ball rolls forward, against the contacts and then away from the contacts over the top of the wall and along a horizontal ramp to the bottom of the container. Upon reversal of the motion, the ball rolls back along the ramp and pitches over the wall top, missing the contacts, to the rear of the container. Thus with an up motion of the rear end of the container, contact is made and then broken, and with a return down motion, the switch is reset without further contact.

The invention is particularly applicable to the activation of a sound module, a device in which the human voice or other sound pattern may be permanently recorded on an integrated circuit or chip. These modules when connected to a source of power and a speaker then play back upon the application of a pulse of power and will continue to repeat the message until that power is removed.

An additional embodiment of the invention is therefore the combination of the above described switch and a sound module in a manner in which a mechanical operation such as the lifting of the toilet seat or the rotation of a door knob will emit a one time message for the benefit of the user.

The advantages and features of the invention will be more fully understood from the description of the preferred embodiment.

DESCRIPTION OF PREFERRED EMBODIMENT

Figure 1:
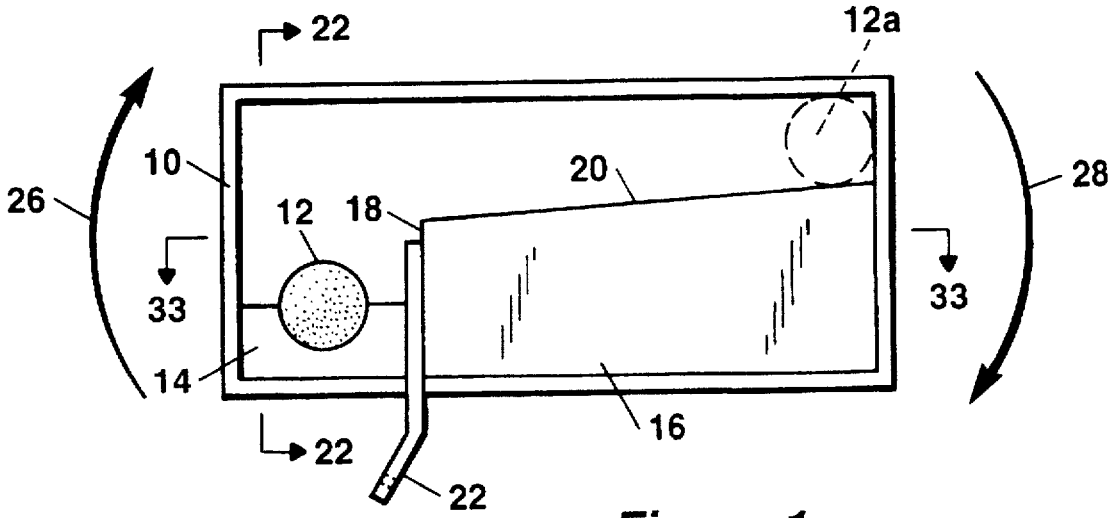
FIG. 1 is a cross-sectional side view of the preferred embodiment.

Referring first to FIG. 1 there is illustrated a cross sectional side view of the preferred embodiment of the invention in which a container 10 has a metallic ball 12 residing in seat 14 disposed therein. Block 16 is positioned forward of seat 14 and has a generally vertical wall 18 and a generally horizontal ramp 20. A pair of electrical contacts 22 and 24 further shown in FIGS. 2 and 3 extend through the container and are positioned against wall 18 spaced apart a distance such that they will be bridged by ball 12 as it rolls forward when container 10 is rotated from the horizontal to the vertical position as indicated by arrows 26 and 28. Ball 12 rests at **12*a*** when the rotation is completed.

Figure 2:
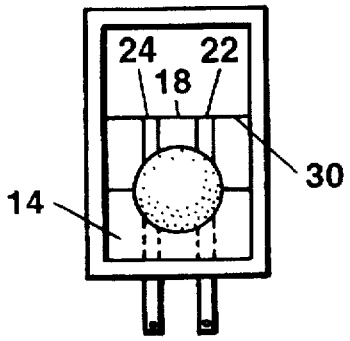
FIG. 2 is a cross-sectional rear view of the embodiment of FIG. 1 along line A—A.
Figure 3:
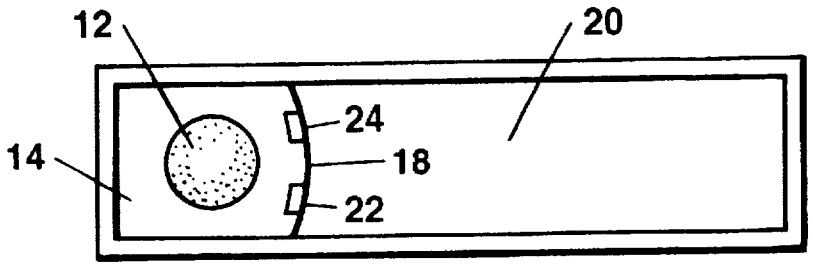
FIG. 3 is a cross-sectional plan view of the embodiment of FIG. 1 along line B—B.

FIG. 2 and 3 illustrate cross-sectional format rear and plan views of the embodiment of FIG. 1. On the return motion from vertical to horizontal ball 12 will return to seat 14 from position **12*a* after rolling over edge 30 of ramp 16. In so doing, it avoids touching contacts 22 and 24 allowing the switch to be reset for another break cycle. Wall 18 may advantageously be curved to facilitate effective contact as shown in FIG. 3**.

Figure 4:
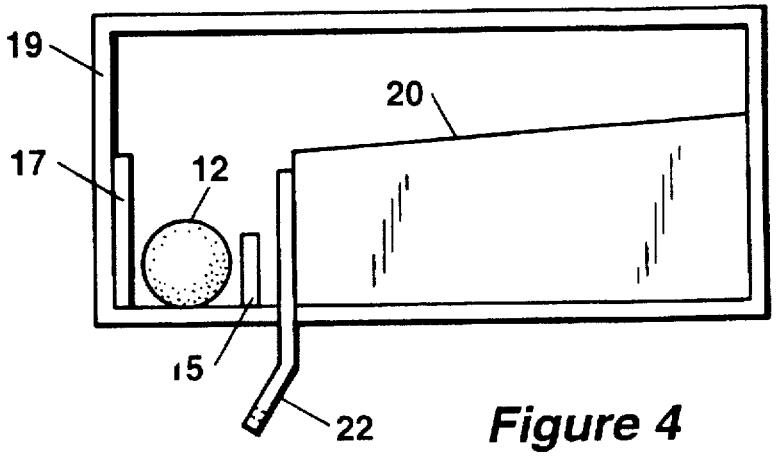
FIG. 4 is a cross-sectional view of an alternative embodiment of the invention.

The parameters and components of the above described structure may be altered to facilitate the operation of the switch. For example as shown in FIG. 4 seat 14 may be removed and replaced by barrier 15 positioned to the rear of wall 18 and cushion 17 added to rear wall 19 of container 10. The purpose of seat 14, barrier 15, and cushion 17 individually or in combination is to prevent ball 12 from rebounding from rear wall 19 and making unwanted contact when the switch is returned to horizontal position. Extending the distance between container rear wall 19 and vertical wall 18 may also accomplish the same result. It should also be understood that the term vertical referring to wall 18 and horizontal referring to ramp 20 should be broadly construed to describe a geometrical configuration in which the ball is first stopped by wall 18 and then upon return, pitched over by ramp 20.

Figure 5:
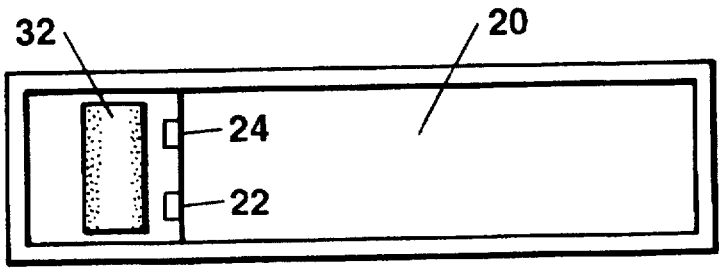
FIG. 5 is a cross-sectional plan view of an alternative embodiment of the invention.

FIG. 5 illustrates the same configuration as FIGS. 1–3 with the exception that ball 12 is replaced by metallic cylinder 32 which performs the same function of bridging contacts 22 and 24 in the, as shown, clockwise rotation of container 10.

Figure 6:
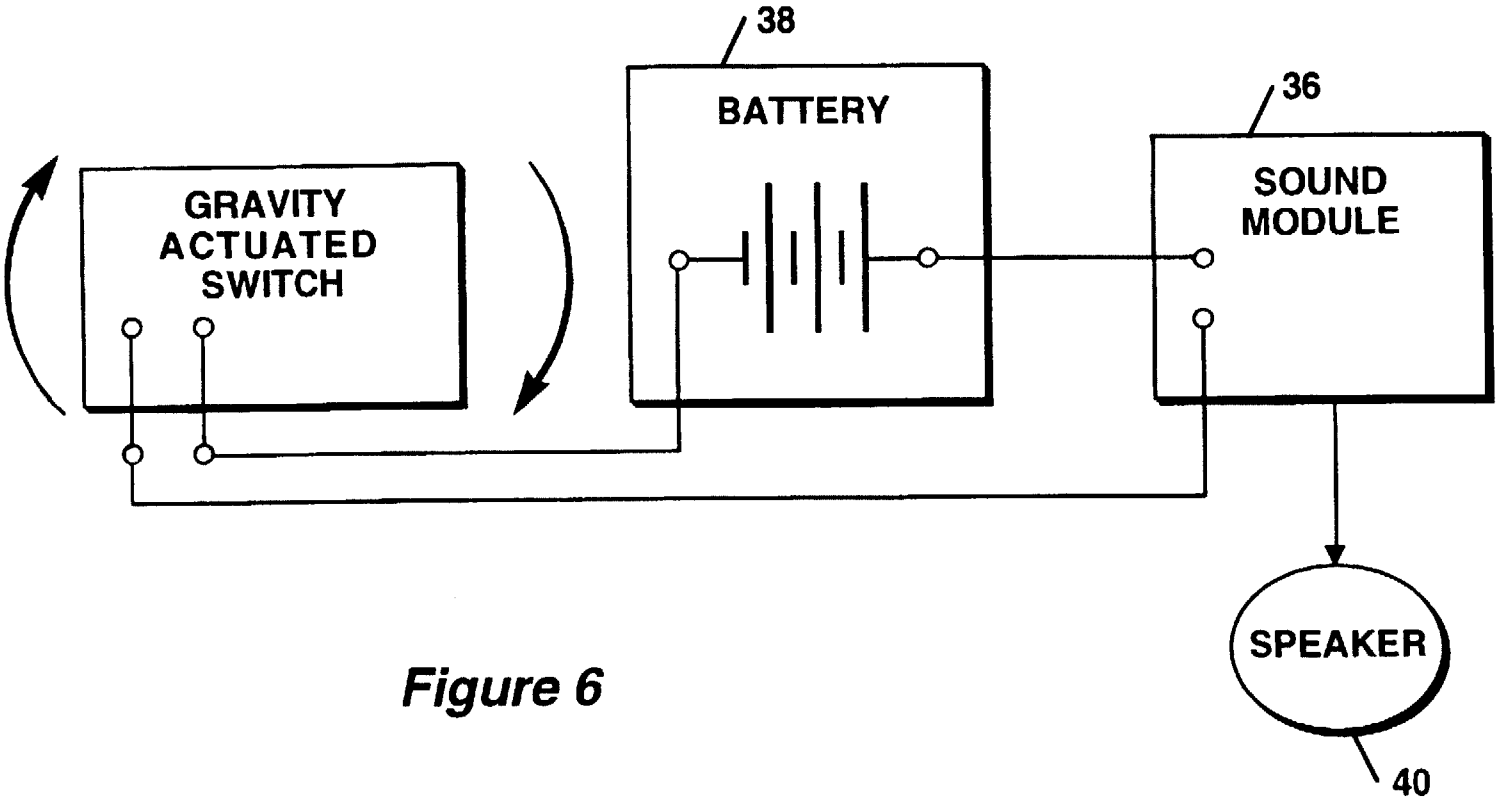
FIG. 6 is a schematic drawing of the embodiment of FIG. 1 disposed in an electrical circuit.

Referring next to FIG. 6, there is shown a schematic diagram illustrating the use of the above described switch in combination with a sound module for producing an audible message upon moving an object to which the switch is attached.

Sound module 36 is powered by battering 38 and upon activation drives speaker 40 to produce a recorded message. Such modules record on an integrated circuit and cycle continuously as long as they are connected to a source of power.

A single motion make-break gravity activated switch 42 of the type described herein is connected between battery 38 and sound module 36. Upon rotation of switch 42 from the horizontal to the vertical position by moving a selected object as indicated by arrows 44 and 46, a pulse of power is transmitted to module 36 to produce a single cycle of whatever message has been recorded on the module.

As modifications of the above described apparatus will now be obvious to those skilled in the art, the invention is hereby defined by the following claims.

What is claimed is:

1. A gravity actuated electrical switch comprising in combination:

a. a container;

b. a metallic electrically conducting rollable member disposed within said container;

c. a vertical wall disposed within said container;

d. a horizontal ramp member disposed forward of said wall, and e. a pair of metallic electrical contacts adjacent said wall, said contacts separated a distance no greater than the length of said rollable member whereby said rollable member will bridge said contacts completing an electrical circuit upon movement of said container from a horizontal toward (to) a vertical position and said rollable member will move beyond said contacts breaking said electrical circuit and onto said ramp member upon further movement of said container to a vertical position.

2. The apparatus of claim 1 further including a seat for said rollable member rearward of said wall.

3. The apparatus of claim 1 further including a partial barrier rearward of said wall.

4. The apparatus of claim 1 wherein said wall has a transverse curvature.

5. The apparatus of claim 1 further including a cushion disposed on the rear interior wall of said container.

6. The apparatus of claim 1 wherein said rollable member comprises a sphere.

7. The apparatus of claim 1 wherein said rollable member comprises a cylinder.

8. The apparatus of claim 1 further including:

a. a source of power, b. a sound module activated by said source; and c. a speaker operated by said module wherein said switch is operatively connected between said source and said module.

9. Apparatus for producing an audible message upon motion of a selected object comprising in combination:

1. a make-break gravity actuated switch attached to said object;

2. a sound module;

3. a source of power for operating said module, said source activated by said switch; and 4. speaker means operated by said module wherein said switch is arranged to energize and then disconnect said source upon the continuous motion of said switch in a single direction.

* * * * *